US010871040B2

(12) United States Patent
Ames et al.

(10) Patent No.: US 10,871,040 B2
(45) Date of Patent: Dec. 22, 2020

(54) CONNECTOR ASSEMBLY

(71) Applicant: RMSPUMPTOOLS LTD, Oldmeldrum (GB)

(72) Inventors: Nigel Ames, York (GB); Matthew Pape, Norton (GB)

(73) Assignee: RMSPUMPTOOLS LTD, Oldmeldrum (GB)

( * ) Notice: Subject to any disclaimer, the term of this patent is extended or adjusted under 35 U.S.C. 154(b) by 200 days.

(21) Appl. No.: 16/097,058

(22) PCT Filed: May 30, 2017

(86) PCT No.: PCT/GB2017/051529
§ 371 (c)(1),
(2) Date: Oct. 26, 2018

(87) PCT Pub. No.: WO2017/207973
PCT Pub. Date: Dec. 7, 2017

(65) Prior Publication Data

US 2019/0085644 A1 Mar. 21, 2019

(30) Foreign Application Priority Data

May 30, 2016 (GB) ..... 1609468.2

(51) Int. Cl.
*E21B 17/02* (2006.01)
*E21B 33/038* (2006.01)
(Continued)

(52) U.S. Cl.
CPC ..... *E21B 17/028* (2013.01); *E21B 33/0385* (2013.01); *H01R 13/533* (2013.01); *E21B 33/12* (2013.01)

(58) Field of Classification Search
CPC ..... E21B 17/028; E21B 33/085; F16L 25/01; H01R 13/005; H01R 13/523
(Continued)

(56) References Cited

U.S. PATENT DOCUMENTS 4,586,774 A 5/1986 Didier
5,051,103 A * 9/1991 Neuroth ..... E21B 33/0385 439/192
(Continued)

FOREIGN PATENT DOCUMENTS

EP 2908396 A1 8/2015
GB 2124038 A 2/1984
(Continued)

OTHER PUBLICATIONS

International Search Report and Written Opinion, PCT/GB2017/051529, dated Sep. 25, 2017, 13 pages.
(Continued)

*Primary Examiner* — Robert E Fuller
*Assistant Examiner* — Lamia Quaim
(74) *Attorney, Agent, or Firm* — Rao DeBoer Osterrieder, PLLC; Dileep P. Rao

(57) ABSTRACT

A penetrator connector assembly is suitable for connecting two parts of an electrical conductor across a pressure barrier in an oil or gas well. The assembly includes a body with a bore for an electrical conductor, a sealing boot that seals an annular space between the conductor and the bore, and a port that transmits a pressure differential between the exterior of the body and the annular space, so that the pressure differential acts on one side of the sealing boot to apply a compressive force and enhance the seal. The assembly also has a spring that can be resiliently energised to apply a compressive force to the sealing boot independently of fluid pressure differentials.

20 Claims, 11 Drawing Sheets

(51) Int. Cl.
*H01R 13/533* (2006.01)
*E21B 33/12* (2006.01)

(58) Field of Classification Search
USPC ..... 439/190–195, 201
See application file for complete search history.

(56) References Cited

U.S. PATENT DOCUMENTS

| | | | |
|---|---|---|---|
| 8,123,549 | B2 | 2/2012 | Jazowski et al. |
| 8,287,295 | B2 | 10/2012 | Sivik et al. |
| 8,968,018 | B2 | 3/2015 | Sivik et al. |
| 2007/0287329 | A1 | 12/2007 | Jackson et al. |
| 2013/0130529 | A1 | 5/2013 | Ayers |

FOREIGN PATENT DOCUMENTS

| | | | |
|---|---|---|---|
| WO | 2011016997 | A2 | 2/2011 |
| WO | 2011017396 | A2 | 2/2011 |
| WO | 2015107358 | A2 | 7/2015 |
| WO | 2017161048 | A2 | 9/2017 |

OTHER PUBLICATIONS

GB Search Report, Application No. GB1609468.2, dated Jul. 19, 2016, 3 pages.

* cited by examiner

DETAIL VIEW A

DETAIL VIEW B

DETAIL VIEW D

CONNECTOR ASSEMBLY

The present application relates to a connector assembly. In particular, the present application relates to a penetrator connector assembly, which is adapted to connect two parts of an electrical conductor across a pressure barrier in an oil or gas well.

Penetrators are often used in pressure barriers of oil and gas well, for example in a packer which is adapted to isolate different zones of an annular area between concentric strings of production tubing and casing. Penetrators are also routinely used in wellheads, for connecting upper and lower limbs of an electrical conductor across the pressure barrier of the wellhead. An end termination on one of the limbs usually passes through at least a part of the pressure barrier to facilitate interconnection between the two limbs of the conductor. The connection between the limbs is normally performed inside the penetrator. In all such cases, it is important that the conductor for e.g. the electrical signals or power etc. has reliable continuity across the pressure barrier, and that the pressurised fluids on each side of the barrier are safely contained. In particular, in the case of oil and gas wells, production fluids on one side of the pressure barrier can be toxic and/or environmentally sensitive, so the containment function of each penetrator is especially important.

WO2015/107358A2, EP2908396A1, and US5051103A are useful for understanding the present invention.

SUMMARY

According to the present invention there is provided a connector assembly for connecting electrical conductors on opposite sides of a pressure barrier in an oil or gas well, the assembly comprising a body having a bore adapted to receive an electrical conductor within the bore, a sealing device adapted to seal an annular space between the electrical conductor and the bore, and a fluid pathway adapted to allow fluid communication between an outer surface of the body and the annular space, wherein the fluid pathway comprises at least one port, and wherein the port is adapted to transmit a pressure differential between the external surface of the body and the annular space to act on one side of the sealing device.

The fluid pathway can incorporate one, or more than one, port, optionally passing through the body into the bore.

Optionally the fluid pathway is adapted to transmit wellbore pressure on one side of the pressure barrier to a surface of the sealing device on the same side of the pressure barrier. Optionally an inner end of a port in the fluid pathway passing through the body has an opening into the bore which is disposed between a portion of the sealing device and a lower end of the body. Optionally the annular space is sealed by the sealing device at one end (optionally an upper end of the annular space). Optionally the bore of the body below the sealing device incorporates a secondary seal spaced from the sealing device, optionally in an axial direction along an axis of the body, optionally at the lower end of the body, but optionally the fluid pressure within the body on the said one end of the sealing device is equalised. Optionally the fluid pressure differential communicated via the bore applies a compressive force to the sealing device, enhancing the seal across the annular space.

Optionally the connector assembly has a resilient compression device adapted to be resiliently energised to apply a compressive force to the sealing device within the annular space. Optionally the resilient compression device applies a force on the sealing device which is independent of fluid pressure within the annular space communicated via the port. Thus, the resilient compression device acts on the sealing device in the absence of fluid pressure differentials acting on the sealing device, and at low pressure differentials below a pressure threshold, the force applied by the resilient compression device can exceed the force applied to the sealing device by the fluid pressure differential. Optionally when the fluid pressure exceeds the pressure threshold, the force applied to the sealing device by the pressure differential exceeds the force applied to the sealing device by the resilient compression device.

Optionally the sealing device is resilient and is optionally compressed by the resilient compression device against the electrical conductor and against the inner surface of the bore. Optionally the resilient compression device applies a compressive force in a direction parallel to the axis of the bore. Optionally the resilient compression device maintains a bias on the internal components in the body.

Optionally the sealing device occludes the annular area of the bore and optionally resists passage of fluids through the bore, optionally above the port, advantageously when compressed by the resilient compression device and/or by the pressure differential. Optionally the sealing device resists axial passage of fluids through the annular space, optionally at a location in the bore above the port.

Optionally the sealing device is compressed between the outer surface of the electrical conductor and the inner surface of the bore. Optionally at least a part of the sealing device is compressed radially against the outer surface of the electrical conductor. Optionally at least a part of the sealing device is compressed radially against the inner surface of the bore. Optionally at least a part of the sealing device is compressed axially within the bore, towards one end of the bore, optionally towards an upper end of the bore. Optionally the radial compression of the part of the sealing device on the outer surface of the electrical conductor is driven at least partly by the pressure differential applied via the fluid pathway; for example, the part of the sealing device on the outer surface of the electrical conductor is optionally in fluid communication with the annular area, whereby pressure differentials communicated to the annular area via the fluid pathway are applied to the part of the sealing device on the outer surface of the electrical conductor to force it radially against the outer surface of the electrical conductor, for example onto an outer sleeve or lining of the conductor, to create or enhance the seal made between the part of the sealing device and the electrical conductor. The part of the sealing device can optionally comprise a sleeve or extension surrounding the electrical conductor and extending from the lower end of the body of the sealing device.

Optionally the geometry of the sealing device and the bore are arranged such that the force applied by the resilient compression device and optionally by the pressure differential results in radial compression of the sealing device in outward and inward radial directions, e.g. radially outwardly against the inner surface of the bore, and radially inwardly against the outer surface of the conductor. This can optionally be achieved or enhanced by resisting axial movement of the sealing device within the bore so that when force is applied in an axial direction, the axial force results in radial inward compression and outward expansion of the sealing device.

Optionally the bore receives the sealing device. Optionally at least one of the sealing device and the section of the bore receiving the sealing device is tapered, or in other words has at least two surfaces that are closer together at one end of the bore (optionally the upper end) than at the other end of the bore (optionally the lower end). Optionally the bore is tapered, but in some examples the sealing device may be tapered. Optionally both are tapered. In one example, the bore walls optionally taper inwards towards the central axis of the bore as the bore extends through the body, at least in a portion of the bore which receives the sealing device, so that the axial movement of the sealing device under the force applied by the resilient compression device causes the sealing device to be compressed radially by the tapered walls as well as axially as a result of the force applied by the resilient compression device, which optionally applies the compressive force in an axial direction parallel to the bore. This can optionally increase the sealing effect of the sealing device against the conductor, and can reduce leaks through the bore between the lower end and the upper end of the connector assembly.

The sealing device optionally surrounds at least a portion of the electrical conductor. The resilient compression device optionally surrounds at least a portion of the electrical conductor. The sealing device is optionally axially displaced from the resilient compression device.

Optionally the body comprises first and second portions, which can optionally be connected by a screw thread arrangement, which is optionally adjustable to vary the force energising the resilient compression device and/or the sealing device. Optionally the sealing device and/or the resilient compression device can be received within one of the first and second portions or between the portions. Optionally the resilient compression device can be resiliently energised by engaging the screw threads between the first and second portions such that they approach one another, and compress the resilient compression device and the sealing device between them.

Optionally the electrical conductor is adapted to transmit electrical power or signals. Optionally more than one electrical conductor is received within the assembly. Optionally the electrical conductor comprises an outer sheath, optionally surrounding an inner insulating sheath. Optionally the inner insulating sheath is electrically insulating. Optionally the inner insulating sheath comprises EPDM or a similarly insulating material. Optionally, the outer sheath surrounds a portion of the electrical conductor. Optionally the outer sheath comprises a material such as lead or fluoropolymer (e.g. Kynar®), where the material acts as a chemical barrier against well fluids entering the electrical conductor. Optionally, the insulating sheath extends axially beyond the outer sheath on the conductor within the assembly. Optionally the conductor extends axially beyond the inner insulating sheath.

Optionally an end terminal is crimped or otherwise attached to the conductor, optionally at an end of the conductor. The end terminal optionally comprises a conductive metal such as copper, and is optionally attached to the conductor by crimping etc. before the conductor is received within the bore of the connector assembly.

Optionally the assembly comprises a bearing ring which optionally surrounds at least a portion of the conductor and/or the terminal. Optionally the bearing ring is made of metal. Optionally the outer surface of the bearing ring tapers towards the axis of the conductor.

Optionally the terminal and/or the conductor are disposed in a bore of an insulating sleeve, optionally comprising PEEK, or another insulating material adapted for use in a downhole connector. Optionally the insulating sleeve is disposed within the bore of the assembly body and optionally comprises at least one bore with an aperture adapted to receive the end terminal of the conductor and/or the connector. Optionally the bearing ring engages a shoulder on an inner surface of the aperture in the insulating sleeve. Optionally the bore of the insulating sleeve comprises an angled section that tapers inwardly towards an end of the conductor, i.e. towards the terminal, which forms the shoulder to engage the bearing ring. Optionally the angle of the taper on the bore of the insulating sleeve matches the angle of the taper on the bearing ring. Optionally the axial thrust load experienced by the terminal and the conductor is at least partially transferred to the insulating sleeve by the bearing ring engaging the shoulder. The bearing ring is optionally mounted on the outer surface of the crimped terminal.

Optionally the end terminal comprises a conductor retaining device, for example a lock ring or a retaining nut, which can optionally be axially spaced from the bearing ring on an opposite face of an aperture into the bore of the insulating sleeve, and can be adapted to retain the conductor within the connector assembly by resisting movement of the retained conductor (i.e. the terminal attached to the conductor) with respect to the insulating sleeve. Optionally the conductor retaining device at least partially surrounds at least a portion of a conductor pin on the crimped terminal. Optionally the conductor pin forms the end termination of the terminal and can be connected to the conductor retaining device by means of a threaded connection. Optionally the conductor retaining device can be connected to the crimped terminal by a threaded connection.

Optionally the threaded connections can be made up after insertion of the conductor into the bore.

Optionally the sealing device can expand and/or contract according to the operating temperature the sealing device is exposed to. Optionally other internal components expand and/or contract according to the temperature they are exposed to in use. Optionally the resilient compression device is adapted to maintain the compressive force on the sealing device and on other components in the bore of the body during expansion and/or contraction of the sealing device or other internal components within the bore. This can help to maintain the seal across the pressure barrier in the event of temperature induced changes in the volume of the sealing device or other components, and can also mitigate indenting, shearing, or crushing of the conductor within the bore.

Optionally the connector assembly comprises at least one electrical insulator which can at least partially surround a part of the conductor. Optionally the electrical insulator is adapted to bridge between an insulating portion of the assembly, for example a PEEK insulator, and the conductor, optionally the portion of the inner insulating sheath that extends beyond the outer sheath. Optionally the electrical insulator is thus adapted to reduce or restrict surface tracking at high voltages. Optionally the electrical insulator compresses radially onto the conductor, and optionally is axially compressed against the sealing device. Optionally the electrical insulator comprises EPDM or another insulator, but can be made from any material with satisfactory insulating properties.

Optionally the sealing device provides a chemical barrier to well fluid entry into the conductor. Optionally the sealing device compresses radially onto the outer sheath surrounding a portion of the conductor. Optionally the sealing device comprises a resilient rubber material such as nitrile rubber, HNBR, or another suitable material that will seal against well fluids at the relevant operating temperatures, for example fluoropolymers such as FKM or FEPM (e.g. AFLAS®). Optionally the sealing device comprises a sealing ring adapted to reduce or restrict fluid ingress around the outside of sealing device between the sealing device and the inner surface of the bore of the body. Optionally the sealing ring is additionally adapted to act as a backup seal for the sealing device. Optionally, the sealing device is moulded around the sealing ring.

Optionally the sealing device and the electrical insulator can be formed as a two-part boot extending around the conductor.

Optionally the bore of the assembly comprises a snap ring at one end of the tapered section of the bore walls, optionally at the widest portion. Optionally the snap ring retains various internal components in place within the bore, and may limit the axial movement of various sliding components. Optionally the snap ring comprises a low friction material such as PEEK.

Optionally the sealing device or other sleeves within the bore that can be produced in different sizes adapted to suit the size of the conductor and/or the bore. This offers a more accurate means of sealing the conductor against fluid ingress.

Optionally, the sealing device comprises at least one sheath portion, optionally extending in an axial direction at least partially over the conductor, and optionally having a bore to receive the conductor. Optionally the sheath portion of the sealing device and the conductor within the bore of the sheath portion are each adapted to be received within a bore on a spring sleeve which is slidable within the body relative to the sealing device and wherein the bore in the spring sleeve is tapered relative to the sheath portion so that the sheath portion is compressed radially between the bore on the spring sleeve and the outer surface of the conductor when the sealing device is engaged.

Optionally the port that passes through the body of the connector forming a part of the fluid pathway connects the opening into the interior of the bore within the annular space with an opening on the outer surface of the body, optionally in a region of the body below the sealing device when it engages the conductor. The port can therefore allow fluid communication between the outer surface of the body and the annular space in the bore below the seal of the sealing device, and hence, any pressure differential between the external surface of the body and the inner surface of the bore below the sealing device also applies a force to the lower face of the sealing device.

Optionally the spring sleeve incorporates a compensation port which permits pressure equalisation across the spring sleeve. The pressure equalisation can act to prevent hydraulic locking of the spring sleeve within the bore of the connector assembly, facilitating axial movement of the spring sleeve when it is engaged with the sealing device. However, equalising the pressure across the spring sleeve also resists formation and maintenance of pressure differentials across the seal between the spring sleeve and the sealing device, thereby reducing or mitigating leaking of wellbore fluids past the sealing device.

Optionally the body of the assembly comprises at least one alignment device adapted to maintain alignment of the body portions and to prevent or restrict relative movement of the body portions. Optionally the connector assembly body comprises at least one fastener, optionally a threaded fastener, for example a cap screw, which extends between components of the body thereby rotationally connecting them together. Optionally the at least one fastener is located between the upper body and the spring sleeve on the resilient compression device.

Optionally the assembly has at least one bearing device, optionally two bearing devices, for example, one bearing device can optionally be located on each side of the resilient compression device, optionally axially in line with the bore of the assembly, each optionally in the form of a disc comprising a low friction material such as PEEK, but can be made from any suitable substance. Optionally the bearing devices reduce friction and resist transfer of torque during rotational movement of the assembly, for example when the portions of the body of the assembly are being connected. Thus optionally the two body portions can be connected by the threaded connector without transmitting torque between the first (upper) body portion and the internal components in the bore, such as the boots 40, 50, the insulating sleeve 60 and the spring 70 and spring sleeve 73.

Optionally the assembly comprises an end cap adapted to close the bore of the body once the connector assembly body is in position over the conductor. Optionally the end cap comprises a resilient sealing device, which seals against the conductor and acts to reduce or restrict fluid and/or debris ingress into the body of the connector assembly. Optionally the end cap is adapted to support the conductor.

According to the present invention there is also provided a method of connecting first and second limbs of an electrical conductor on opposite sides of a pressure barrier in an oil or gas well, the method comprising passing the first limb of the electrical conductor into a body of a connector assembly, said body having a bore adapted to receive the first limb of the electrical conductor within the bore, wherein the method includes the steps of sealing an annular space between the first limb of the electrical conductor and the bore with a sealing device; wherein the body comprises a fluid pathway adapted to allow fluid communication between the outer surface of the body and the bore, and wherein the method includes transmitting a fluid pressure differential between the outer surface of the body and the bore through the fluid pathway and into the annular space to act on one side of the sealing device.

Optionally the method includes resiliently energising a resilient compression device; and optionally applying a compressive force from the resilient compression device to the sealing device within the annular space.

Optionally as the connector assembly is installed on the conductor the resilient sealing device is not energised in order to permit passage of the conductor within the bore of the body. Optionally after installation of the connector assembly a threaded portion of the body is partially tightened. Optionally partial tightening of the threaded portion of the body energises the resilient sealing device. Optionally energising of the resilient sealing device acts to reduce or restrict fluid migration along the outside of the conductor within the bore of the body. Optionally the resilient sealing device comprises a bore adapted to permit pressure equalisation between each side of the resilient sealing device.

Optionally the resilient compression device is adapted to maintain the resilient sealing device in an energised configuration. Optionally when the resilient sealing device is energised it is axially compressed, and optionally radially compressed. Optionally the energised resilient sealing device is compressed radially onto the outer surface of the conductor within the bore of the body. Optionally the resilient compression device, when engaged, retains partial flexibility and can absorb movement of the resilient sealing device as a result of temperature fluctuations.

Ideally, the crimped terminal can be attached to the conductor at the well location, after cutting the conductor to a suitable length on site, which allows the terminal to be pre-formed in factory conditions, and quickly attached to the conductor on site to permit time and material savings without compromising on the quality of the termination.

The invention also provides a penetrator assembly for connecting electrical conductors on opposite sides of a pressure barrier in an oil or gas well, the penetrator having a body, the body having a bore adapted to receive an electrical conductor within the bore, and having a terminal attached (optionally crimped) onto the electrical conductor, the assembly having at least one sleeve within the annular space between the outer surface of the conductor and the inner surface of the bore, wherein the body comprises a fluid pathway adapted to allow fluid communication between the outer surface of the body and the opening of the fluid pathway into the bore.

Optionally the penetrator assembly has a resilient compression device adapted to be resiliently energised to apply a compressive force to the at least one sleeve within the annular space.

Optionally the terminal is preformed and can be attached at the well site just before the conductor is made up into the body of the assembly.

The various aspects of the present invention can be practiced alone or in combination with one or more of the other aspects, as will be appreciated by those skilled in the relevant arts. The various aspects of the invention can optionally be provided in combination with one or more of the optional features of the other aspects of the invention. Also, optional features described in relation to one aspect can typically be combined alone or together with other features in different aspects of the invention. Any subject matter described in this specification can be combined with any other subject matter in the specification to form a novel combination.

Various aspects of the invention will now be described in detail with reference to the accompanying figures. Still other aspects, features, and advantages of the present invention are readily apparent from the entire description thereof, including the figures, which illustrates a number of exemplary aspects and implementations. Any subject matter described in the specification can be combined with any other subject matter in the specification to form a novel combination. The invention is also capable of other and different examples and aspects, and its several details can be modified in various respects, all without departing from the scope of the present invention as defined by the claims. Accordingly, the drawings and descriptions are to be regarded as illustrative in nature, and not as restrictive. Furthermore, the terminology and phraseology used herein is solely used for descriptive purposes and should not be construed as limiting in scope. Language such as "including", "comprising", "having", "containing", or "involving" and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes. Thus, throughout the specification and claims unless the context requires otherwise, the word "comprise" or variations thereof such as "comprises" or "comprising" will be understood to imply the inclusion of a stated integer or group of integers but not the exclusion of any other integer or group of integers.

Any discussion of documents, acts, materials, devices, articles and the like is included in the specification solely for the purpose of providing a context for the present invention. It is not suggested or represented that any or all of these matters formed part of the prior art base or were common general knowledge in the field relevant to the present invention.

In this disclosure, whenever a composition, an element or a group of elements is preceded with the transitional phrase "comprising", it is understood that we also contemplate the same composition, element or group of elements with transitional phrases "consisting essentially of", "consisting", "selected from the group of consisting of", "including", or "is" preceding the recitation of the composition, element or group of elements and vice versa. In this disclosure, the words "typically" or "optionally" are to be understood as being intended to indicate optional or non-essential features of the invention which are present in certain examples but which can be omitted in others without departing from the scope of the invention.

All numerical values in this disclosure are understood as being modified by "about". All singular forms of elements, or any other components described herein are understood to include plural forms thereof and vice versa. References to directional and positional descriptions such as upper and lower and directions e.g. "up", "down" etc. are to be interpreted by a skilled reader in the context of the examples described to refer to the orientation of features shown in the drawings, and are not to be interpreted as limiting the invention to the literal interpretation of the term, but instead should be as understood by the skilled addressee.

DETAILED DESCRIPTION

According to a first example, a connector assembly 1 comprises a body 30 having a bore 30*b* to receive an electrical conductor within the bore 30*b*. In this example the conductor comprises a three phase electrical cable 5 having three separate internal electrical conductors 5*c* for transfer of power or signals in a downhole environment. In other examples, the conductor can have a single phase, two phases, or more than three.

The assembly 1 in this example also comprises a resilient sealing device in the form of a sleeve that seals an annular space between the outer surface of the cable 5 and the inner surface of the bore 30*b* of the body 30 when the sealing device is compressed within the annular space by a resiliently energised compression device, here shown as a wave spring 70, which is held in compression to exert the compressive force on the internal components of the assembly 1 as will be described in more detail below.

Figure 1:
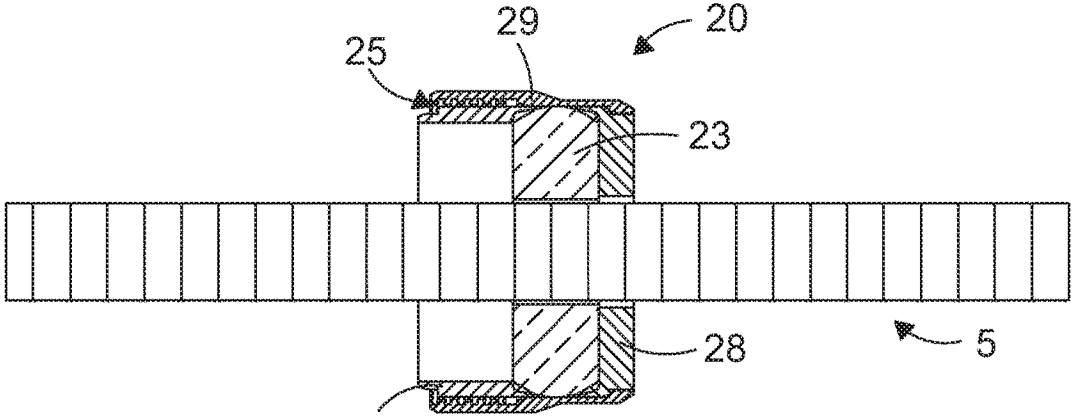
FIG. 1 shows a side view of an example of the invention, where the electrical conductor is an armour-covered cable, with a cross-sectional view of an end cap.

FIG. 1 shows the cable 5 with an end cap positioned on the cable 5 ready for making up the cable 5 into the connector assembly 1. In this example, the end cap incorporates a clamping device such as a cable gland 20 which surrounds the outer surface of the cable 5 and retains it in a central aperture. In this example, the cable 5 is a multi-phase (3 phase in this example) flat cable and the gland 20 has a non-circular aperture to allow the cable 5 to pass through the aperture. The cable 5 has an armoured outer layer and the gland 20 is slid over the armoured outer layer prior to installation of the connector assembly 1. The gland 20 comprises a seal 23 in the form of a rubber bung, through which the non-circular aperture passes. The gland 20 seals around the armoured outer sheath of the cable 5 and reduces or restricts ingress of well fluids and debris into the body 30 through the gland. The seal 23 can be made of any suitable material that is resistant to well fluids and can withstand the relevant operating temperature. By way of example, suitable materials could include nitrile rubber or a member of the fluoropolymer family with appropriate chemical properties. The gland 20 also comprises a low friction ring 26 comprising PEEK or another low friction material to reduce friction between the cable clamp seal 23 and the rear of the body 30; a metal ring 28 on the other side of the seal 23 which pressed on the rear of the seal 23 to compress the seal 23 into the armoured sheath of the cable 5; and a lock ring 29, which holds all of the gland components in place and comprises a threaded portion 25, by which the gland 20 attaches to a rear end of the body 30.

Figure 2:
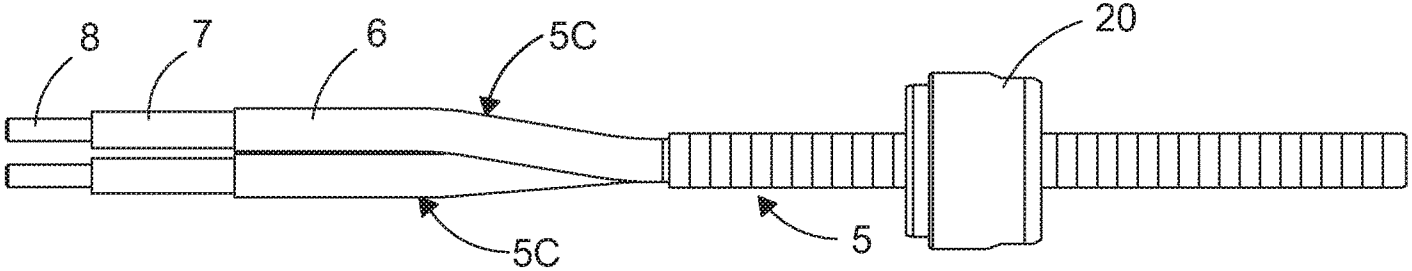
FIG. 2 shows a side view of the cable of FIG. 1 sequentially stripped and ready for termination.

The cable 5 must be stripped in order to expose the conductor core for termination prior to installation of the connector assembly 1. FIG. 2 shows the cable with the armoured outer layer stripped back to expose the conductors 5*c* with their sheaths covering the conductor cores. An outer sheath 6 on each conductor 5*c* provides a chemical barrier to well or other fluids. In this example the outer sheath 6 comprises lead. Within the outer sheath 6 is an inner sheath 7, which in this example comprises an electrical insulator, in this case EPDM. Finally the conductive central core 8 (in this example comprising copper) is exposed and can then be terminated.

Figure 3:
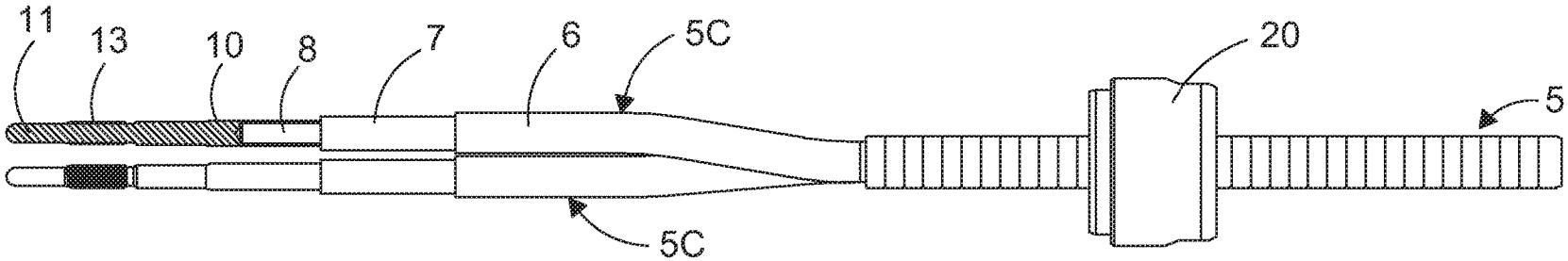
FIG. 3 shows a side view of the terminated cable of FIG. 2 with terminals crimped onto the conductors.

FIG. 3 shows terminals 10 being crimped onto the free ends of the exposed copper cores 8 to terminate the conductors 5*c* and permit a suitable connection between separate limbs of conductor 5*c* above and below a pressure barrier, for example, a packer or wellhead. This is suitably performed at the well site and allows a factory-made terminal 10 to be crimped onto different lengths of conductor to suit the local circumstances. Therefore, the cable does not need to be cut to length before deployment, and can be deployed, cut and then terminated all at the well site, saving on time, materials and transport costs. The crimped end terminals 10 each have a contact pin 11 at the free end of the terminal and a thread 13 on its outer surface for attaching a lock ring 15 described in further detail below.

Figure 4:
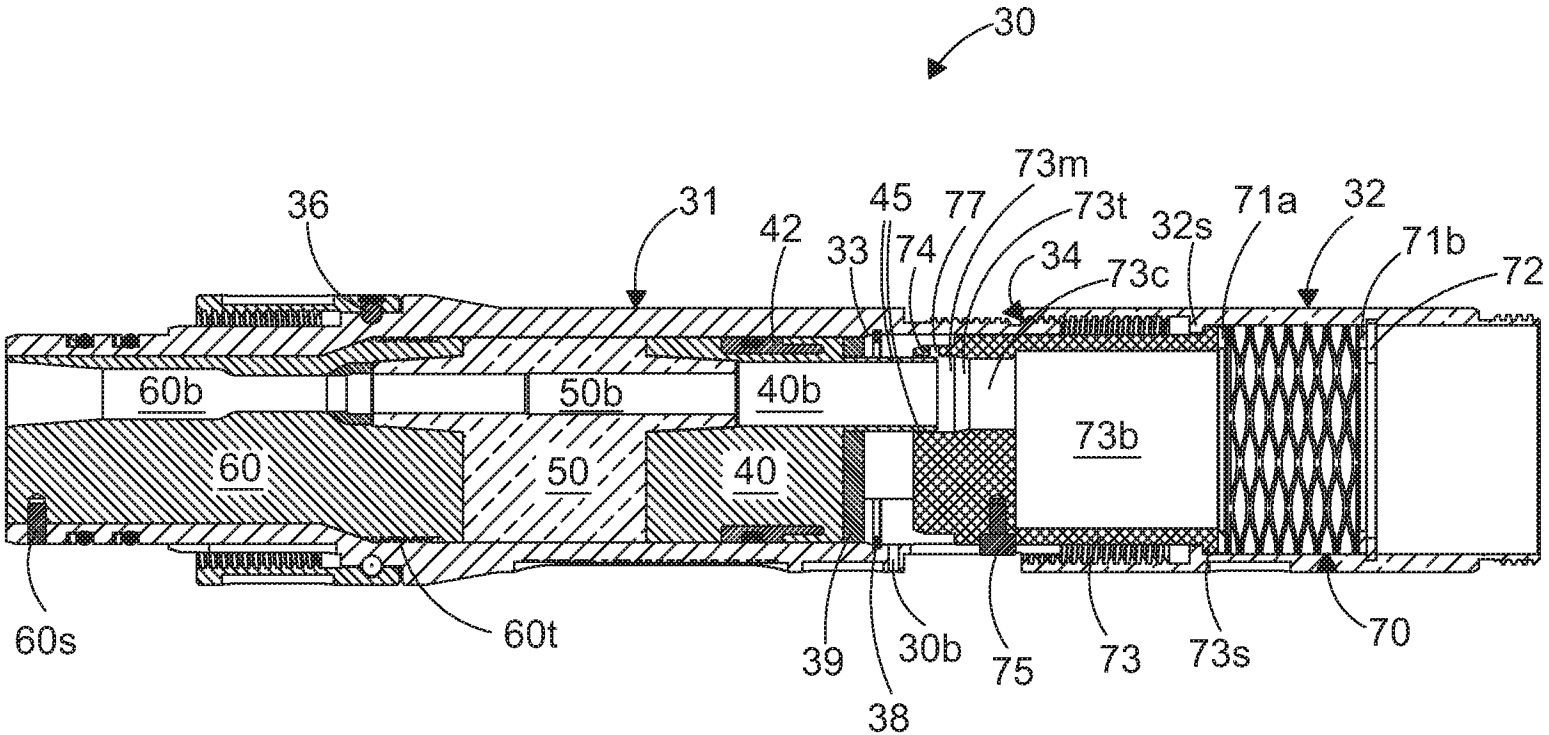
FIG. 4 shows a cross-sectional view of the connector assembly.

The connector assembly body is shown pre-installation in FIG. 4. The body 30 comprises first 31 and second 32 portions connected by a threaded connection 34. The threaded connection 34 is adjustable and can be tightened or loosened, which can change the energisation of the spring 70. The first portion 31 comprises a cylindrical sleeve that contains a resilient sealing device in the form of a resilient rubber sealing boot 40 which in this example comprises a sleeve with at least one bore 40*b* formed around the outer surface of the conductor 5*c* (e.g. the sheath 7 or 6 or the core 8), an electrical insulator in the form of an insulating boot 50 also in this example comprising a sleeve with at least one bore 50*b* formed around the outer surface of the conductor 5*c* (e.g. the sheath 7 or 6 or the core 8), and an insulating sleeve 60. The insulating sleeve 60 is disposed within the bore 30*b* of the upper body portion 31 of the assembly 1, being fixed in position below a narrow throat at the upper end of the body with a screw thread arrangement 60*t*, and secured therein against rotation by a set screw 60*s* and has at least one inner bore 60*b* adapted to receive the or each terminating apparatus of at least one core cable 8. The set screw 60*s* holds the insulating sleeve 60 in alignment with the body 30 and resists relative rotation. The screw thread arrangement 60*t* and the narrow throat limit upward axial movement of the boots 50, 40 within the bore 30*b*. The bores 40*b*, 50*b*, and 60*b* are maintained in alignment with one another within the body 30. In this example, each of the boots 40 and 50 and the insulating sleeve 60 has three bores (visible in FIG. 13), held in alignment within the body 30.

A spring sleeve 73 is also rotationally connected to the first (upper) body portion 31 by a cap screw 75, which maintains alignment of the two components and stops the spring sleeve 73 from turning relative to the first (upper) body portion 31 during rotation of the two body portions 31, 32 when the connector assembly is being made up. The spring sleeve 73 is adapted to slide axially within the bore of the body portion 32, but cannot rotate therein.

In the FIG. 4 configuration, the body portions 31, 32 have not yet been screwed together, and the spring 70 is only slightly energised (perhaps about 10-20% energised) in axial compression between a circlip 72 at the lower end of the second portion the spring sleeve 73 above the spring, which transmits the spring force to the component in the bore (e.g. the boots 40, 50 and the insulating sleeve 60) above the spring sleeve 73 when the body 30 is fully made up. The spring sleeve 73 has a lower portion with a single central bore 73*b*, and an upper portion with three separate bores 73*c* aligned with the bores 40*b*, 50*b* and 60*b*, for accommodating the conductors 5*c* of the separate phases. Each of the separate bores 73*c* terminate at their lower ends in apertures into the central bore 73*b*, and are held in the same rotational position within the bore of the body 32 by the cap screw 75, which slides axially within a slot in the body 32.

The spring 70 is separated from the circlip 72 and the spring sleeve 73 by two low friction (e.g. PEEK) discs 71*a,b*, with each disc 71*a,b* disposed on axially opposite sides of the spring 70, in line with the bore 30*b* of the body of the assembly 30. The discs 71*a,b* act as bearings to reduce and ideally eliminate friction and transfer of torque to the spring sleeve 73 during rotational movement of the assembly 1, for example when the portions 31, 32 of the body 30 of the assembly 1 are screwed together at the threaded connection 34. The spring sleeve 73, the discs 71, the circlip 72 and the spring 70 all contain bores to receive a portion of the cable 5 when the assembly body 30 is installed on the cable 5.

In the configuration shown in FIG. 4, the two body portions 31, 32 have not been fully screwed together, and the spring sleeve 73 is therefore not yet engaged with the resilient sealing boot 40, as a radially outwardly extending shoulder 73*s* on the lower end of the spring sleeve 73 has engaged against a radially inwardly extending shoulder 32*s* on the inner surface of the body portion 32. The spring 70 is slightly (but not fully) energised between the circlip 72 and the lower end of the spring sleeve 73, which helps to maintain the spring sleeve 73 in the upper position with the shoulders 73*s* and 32*s* engaged. The bore of the body 30*b* receives the spring sleeve 73 between the first and second portions 31, 32 of the body 30.

Above the lower end of the first body portion 31, a snap ring 38 is held in a circumferential groove in the inner wall of the body portion 31 and above the snap ring 38, the walls of the bore 30*b* taper inwards at 33 towards the central axis of the bore 30*b* as the bore 30*b* extends through the body 30. The snap ring 38 extends radially a short distance into the bore 30*b*. The snap ring 38 acts to hold the boots 40, 50 in position during removal of the conductor from the connector assembly 1. The snap ring 38 also prevents the boot 40 re-engaging with the spring sleeve 73 after removal of the conductor, by retaining the boot sleeve 40 in its axial position, thus preventing the two components contacting and engaging each other. The snap ring 38 optionally sets the upper limit for the permitted axial movement of the spring sleeve 73 within the bore.

The spring sleeve 73 has an upper portion 74 with a reduced outer diameter which can fit inside the snap ring 38. The upper end of the upper portion 74 is also tapered radially inwards towards the central axis of the bore 30*b*, and has a flat upper face at its upper axial end.

At the upper narrow end of the tapered wall 33 of the first body portion 31, there is a metal plate 39, which is not secured to the body 30 and is free to slide axially within the bore 30*b*, and which transmits the mechanical loading applied by the spring 70 via the spring sleeve 73 and distributes the load across the rear face of the resilient sealing boot 40 when the connector assembly is fully made up. At the lower widest end of the tapered wall 33, the PEEK snap ring 38 is held in the circumferential groove.

The insulating boot 50 above the sealing boot 40 is electrically insulated and provides an insulating bridge between the insulating sleeve 60 and the inner electrically insulating sheath 7 of the core 8. The upper insulating boot 50 is axially compressed between the lower sealing boot 40 and the insulating sleeve 60. The upper insulating boot 50 has upper and lower protrusions surrounding each bore 50*b*, which extend axially in opposite directions, and which are tapered radially inwards towards their outer ends, which are received within correspondingly tapered recesses in the lower sealing boot 40 and the insulating sleeve 60 as is best shown in FIG. 4. Because of the tapered upper and lower protrusions and their respective recesses in the adjacent components, the axial compression of the upper insulating boot 50 by the force of the spring 70 also compresses the upper insulating boot 50 radially inwards onto the inner sheath 7 of the conductor. Thermal expansion and contraction of the upper insulating boot 50 after the connector is made up is accommodated by the spring 70, which unloads in the event of thermal contraction of the insulating boot 50, and is compressed (energised) in the event of thermal expansion of the insulating boot 50.

Figure 8:
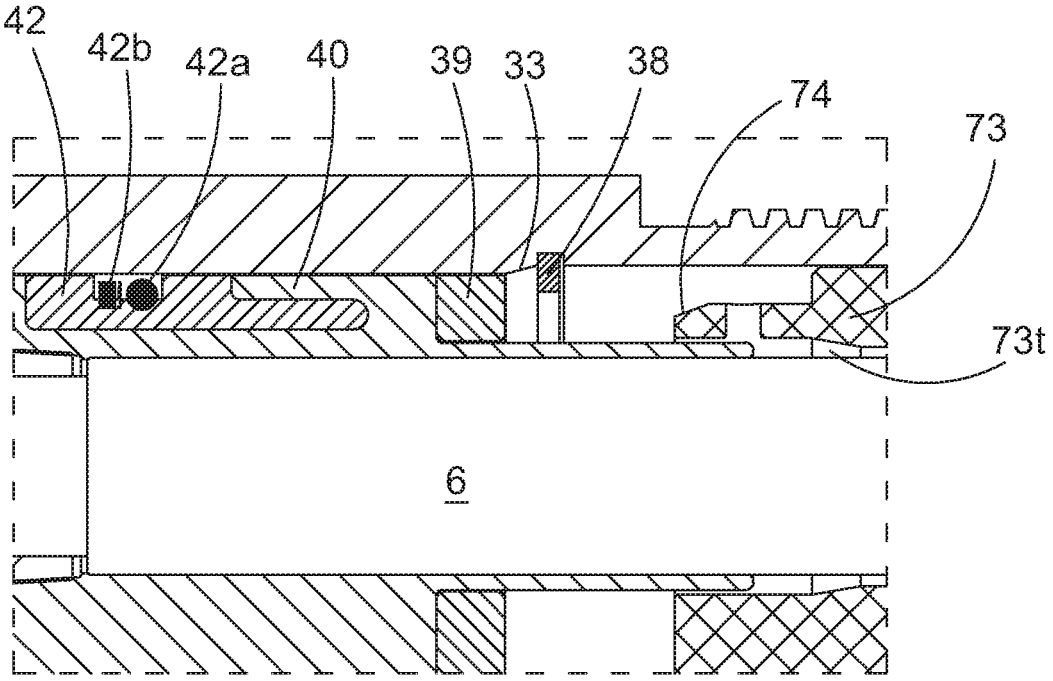
FIG. 8 is a close-up view of the section A of FIG. 5, prior to energising the sealing device.
Figure 9:
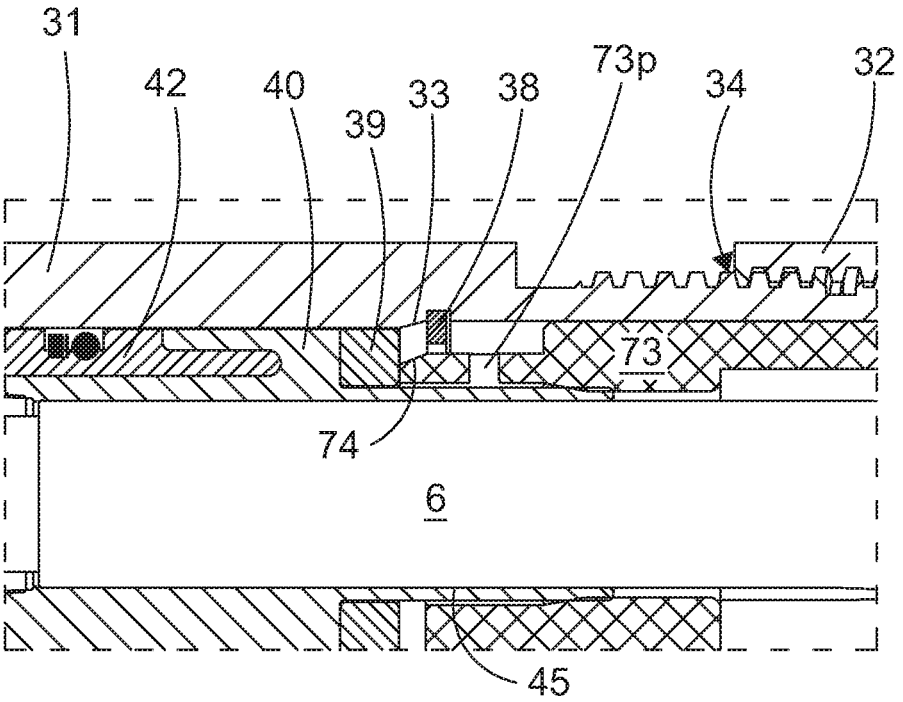
FIG. 9 is a close-up view of the section B of FIG. 7, showing the sealing device partially energised.

The lower sealing boot 40 includes at least one, but in this case, three axially extended tubular extensions in the form of a sheath 45. One sheath 45 is shown in FIG. 4, arranged as a continuous extension from the boot 40 and extending downwards over a part of the outer sheath 6 of each conductor 5*c* (while only one is visible in section in FIG. 4, the other sheaths 45 are the same) and forming a chemical barrier to well fluid entry along the outer surfaces of the conductor 5*c* and into the bores 40*b*, 50*b*, 60*b*, mitigating against the potential catastrophic damage fluid ingress could cause to an electrical system. The extended sheath 45 is received in a bore 73*c* of the upper end of the spring sleeve 73 as it engages with the body 30. Each bore 73*c* has a generally wide mouth at its upper end and a narrowing tapered throat 73*t* as is best seen in FIG. 8, which tapers to a narrower section below the tapered throat 73*t*. As the spring sleeve 73 is forced axially upwards in the body 30 relative to the sealing boot 40, the sheath 45 extending from the lower end of the boot 40 into the bore 73*c* moves further down the bore 73*c*. The sheath 45 can be received within the upper wide mouth 73*m* of the bore above the narrow throat 73*t*, but the lower end of the throat and the lower section of the bore 73*c* below it is narrower than the mouth 73*m* and narrower than the uncompressed outer diameter of the sheath 45, so as the sheath 45 moves down into the throat it is gradually radially compressed between the inner surface of the narrow throat 73*t* and the outer surface of the conductor 5*c* in the bore 73*c* (see the transition between FIGS. 8 and 9).

The sealing boot 40 also has a sealing ring 42 on its outer surface, which acts as a secondary, back up seal to reduce or restrict fluid ingress around the outside of the sealing boot 40. The sealing boot 40 is moulded around the sealing ring 42, as best seen in FIG. 4, which is arranged in a recess in the outer surface of the sealing boot 40. The sealing ring 42 comprises an O-ring 42*a*, and a backup seal 42*b* with a square cross section. The backup seal 42*b* prevents extrusion of the O-ring 42*a* when the O-ring 42*a* is exposed to pressure differentials during operational use of the connector assembly. By resisting extrusion of the O-ring 42*a* from the groove, the backup seal 42*b* thus also assists with maintaining continuous compression of the O-ring 42*a*. As the sealing boot 40 is axially compressed by the spring 70, the outer surfaces of the sealing boot 40 are forced radially outwards, thereby enhancing the seal.

The bore of the upper body portion 31 also has a radial port 30*p* (seen in section in FIG. 5) forming part of a fluid pathway which passes radially through the wall of the body portion 31 and connects the annular area between the spring sleeve 73 and the inner surface of the body portion 31 with the outer surface of the body 30. The port 30*p* is located in a region of the body portion 31 that is just below the snap ring 38. The port 30*p* allows fluid communication between the outer surface of the body 30, and the annular space in the bore 30*b* below the seal created by the sealing boot 40. The upper end of the spring sleeve 73 also has a port 77, which acts as a compensation channel (see FIG. 4) to allow pressure equalisation between the outer and inner surfaces of the spring sleeve 73.

The pressure differential between the external surface of the body 30 and the inner surface of the bore 30*b* below the seal of the spring sleeve 73 is therefore communicated to the lower side of the sealing boot 40, and thus also applies a force to the sealing boot 40, acting to compress the sealing boot 40 axially. Axial movement of the boot 40 within the bore 30*b* is limited by the insulation sleeve 60 being secured in the bore above the boots 50, 40, so axial upward force from the pressure differential across the sealing boot 40 and the expansion of the spring 70 below it results in axial compression of the sealing boot 40 leading also to radial expansion of the boot 40 as a result of the tapered inter-engaging section of the boots 40, 50, forcing the outer surface of the sealing boot 40 radially outwards against the inner surface of the internal bore 30*b* of the body 30. The axial compression of the boot 40 also forces the inner surface of the bore 40*b* of the boot 40 radially inwards, compressing it radially against the outer surface of the conductor 5*c*, thereby enhancing the seal between the boot 40 and the conductor 5*c*, and resisting transmission of wellbore fluids through the bore 40*b* past the conductor 5*c*.

As the spring sleeve 73 is urged axially upwards in the bore 30*b* relative to the stationary sealing boot 40, the lower end of the sheath 45 is received within the narrow throat 73*t* of the spring sleeve, which is narrower than the outer diameter of the sheath 45, and so compresses the lower end of the sheath 45 radially inwards onto the outer surface of the conductor 5*c*. The wellbore fluid pressure applied via the port 30*p* also acts on the sheath 45, the outer surface of which is in fluid communication with the annular space in the bore 30*b*, and enhances the radial compression of the sheath 45 onto the conductor 5*c*. This in turn creates or enhances the seal between the boot 40 and the conductor 5*c*. Fluid pressure outside the spring sleeve 73 and below the spring sleeve 73 in the bore 30*b* of the body also equalises across the spring sleeve 73 via the port 77, and so enhances the force acting to seal the sheath 45 onto the outer surface of the conductor 5*c*.

The spring 70 applies a force on the spring sleeve 73, and therefore the boot 40, independently of the fluid pressure within the annular space in the bore 30*b*. At low fluid pressure, below a given pressure threshold, the force that the spring 70 applies to the spring sleeve 73 and thus to the boot 40 exceeds the force applied by the fluid pressure differential across the ports 30*p* and 77. As the fluid pressure increases and exceeds the pressure threshold, the force applied to the spring sleeve 73 and the boot 40 by the fluid pressure differential then exceeds the force applied by the spring 70. The fluid pressure enhances the radial compression of the sheath 45 against the conductor 5*c*. The pressure of the fluid within the annular space also acts on the face of the boot 40 in an axial direction, compressing the boot 40 axially and driving the radial expansion of the boot 40 as described above.

Figure 5:
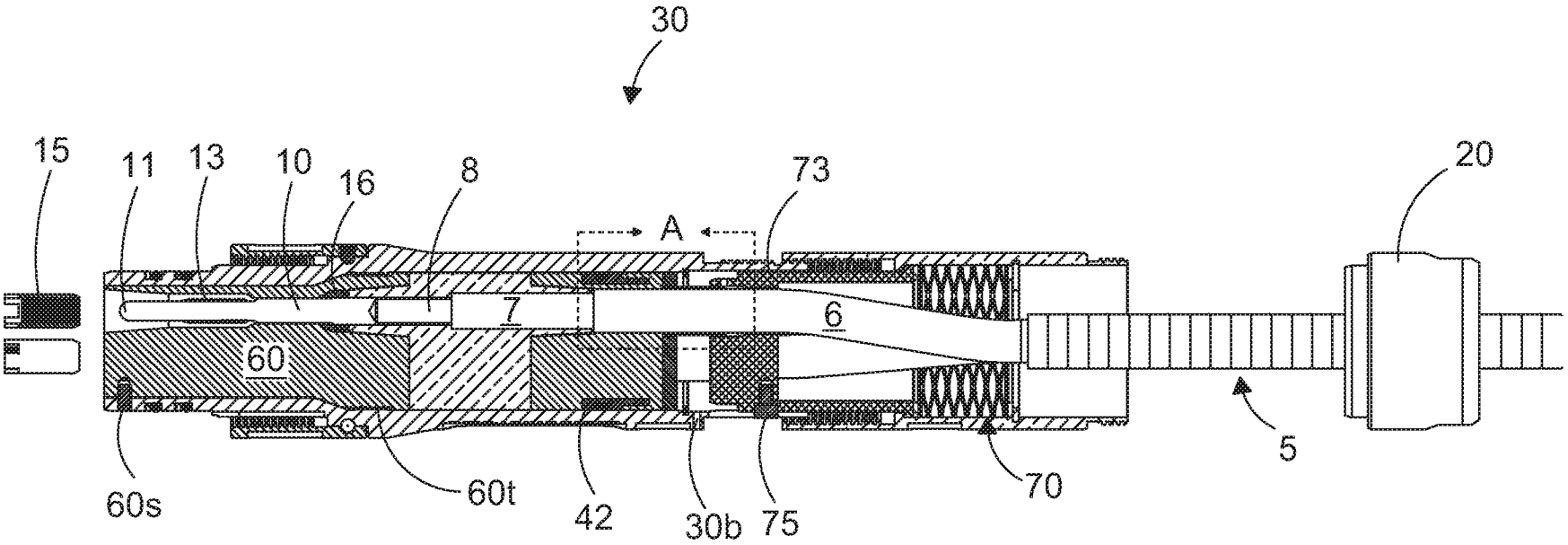
FIG. 5 shows a cross-sectional view of the connector assembly of FIG. 4 installed on the cable.

FIG. 5 shows the connector assembly 1 installed onto the terminated conductor 5. The internal conductors 5*c* (only one is visible in FIG. 5) complete with copper end terminals 10 crimped in place on the cores 8 are inserted into apertures (60*b* in FIG. 4) within the insulating sleeve 60 once the insulating sleeve 60 is fixed in place. The spring sleeve 73 is disengaged from the sealing boot 40 as can be seen in the close-up view of FIG. 8. The gland 20 has not yet been connected and remains loose on the conductor 5.

The crimped terminal 10 that connects the core 8 with the electrical contact pins 11 for making an electrical connection to an adjacent conductor on the other side of the pressure barrier is at least partially surrounded by a bearing ring 16 when the connector assembly 1 is installed. The outer surface of the bearing ring 16 is tapered radially inwards towards the terminal 10 to form an external shoulder, which then engages with an internal shoulder of the insulating sleeve 60 having a corresponding taper.

Figure 6:
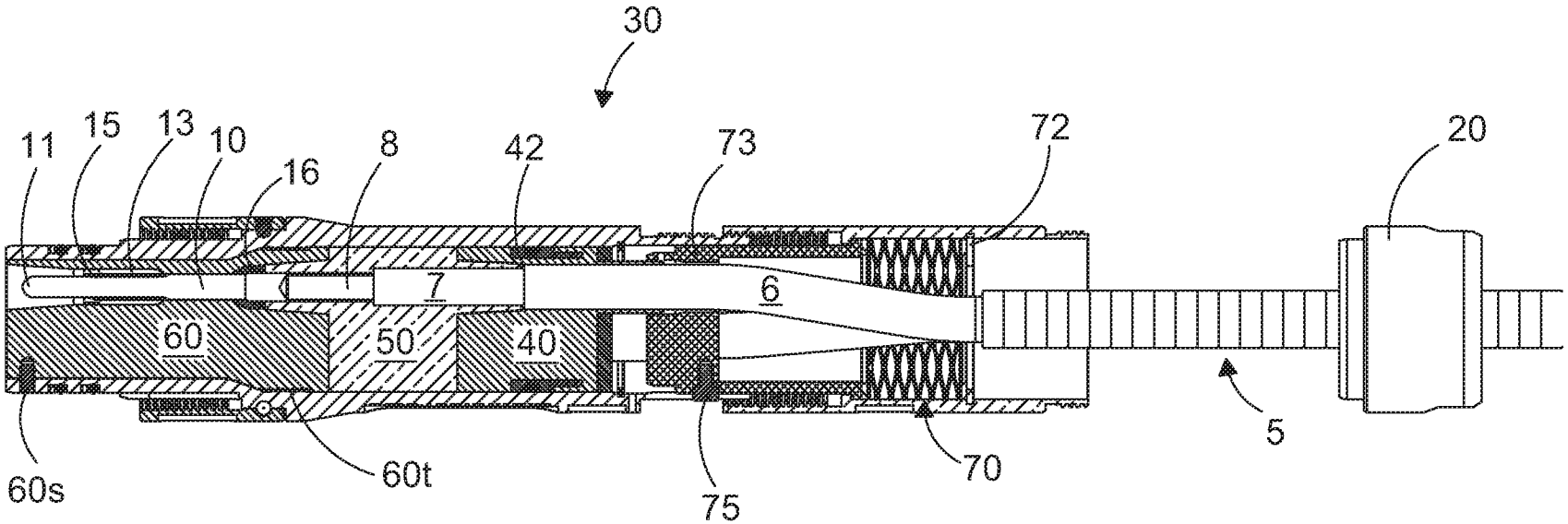
FIG. 6 shows the installed connector assembly of FIG. 5 secured to the cable by retaining nuts.

Once the bearing ring 16 is shouldered out on the insulating sleeve, a retaining device in the form of a lock ring 15 is screwed onto the threads 13 on the outer surface of the terminal 10 as shown in FIG. 5. The electrical contacts 11 on the end of the crimped terminal 11 extend through the lock ring 15. The lock ring 15 helps to hold the crimped terminal 10 in place within the connector assembly 1, as the insulating sleeve 60 is effectively clamped between the outer surface of the bearing ring 16 and the inner surface of the lock ring 15. The lock ring 15 is threaded onto the threaded portions 13 of the contact pin 11 and surrounds part of the contact pin 11. FIG. 6 shows the connector assembly with the lock ring 15 in place on the contact pin 11. When the shoulders of the bearing ring 16 and the insulating sleeve 60 are engaged, any tensile loads applied to the conductor 5*c* are transferred from the crimped terminal 10 to the insulating sleeve 60. The body portion 31 has on its upper end an alignment slot 31*s* (best seen in FIG. 13) to control alignment of the mating connector on the other side of the pressure barrier. The insulating sleeve 60 electrically insulates the end terminal from the body 30.

Figure 7:
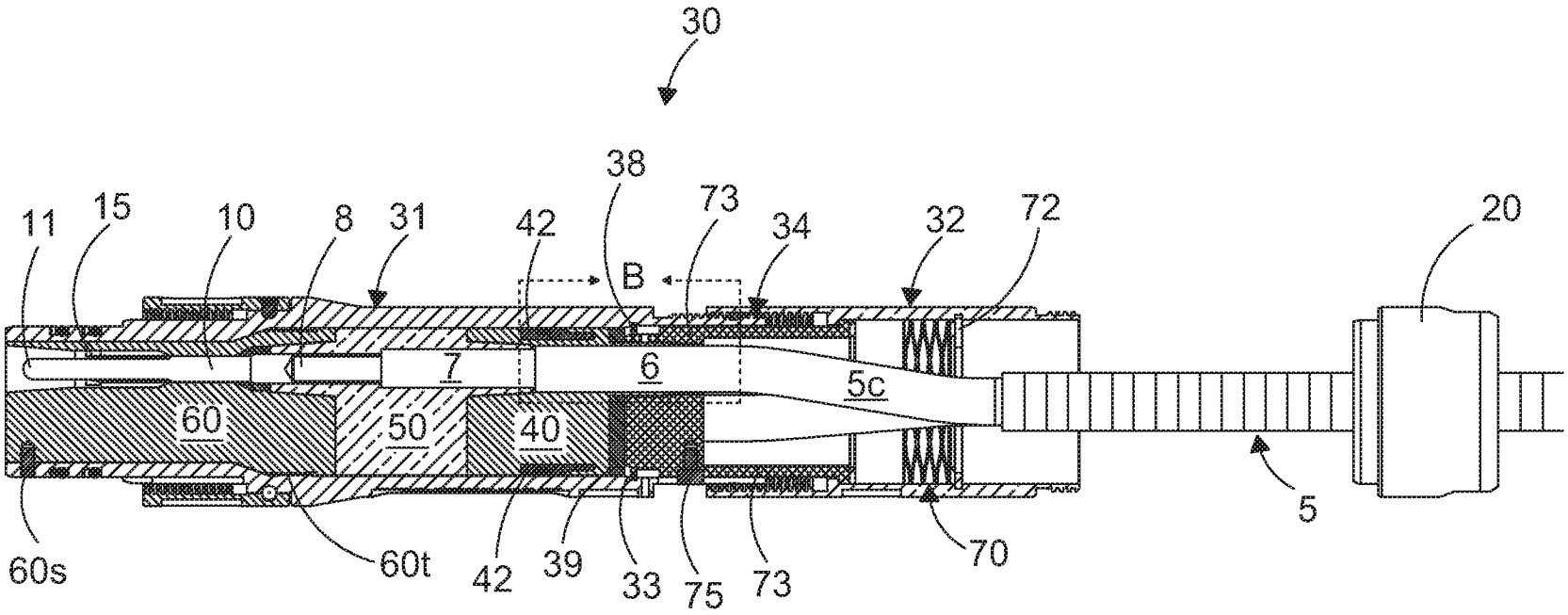
FIG. 7 shows the connector assembly of FIG. 6 with the rear portion of the assembly having been partially tightened to energise the sealing device.

The conductor 5*c* can be offered up to its respective bore in the body 30 and secured in place in the connector assembly 1 by the lock ring 15 as shown in FIG. 6 before or after the second portion 32 of the body 30 is partially tightened onto the first portion 31 by threading the second portion 32 along the thread 34 a short distance as shown in the transition between FIG. 6 and FIG. 7. At this stage, as shown in the detailed view of FIG. 8, which is a close up of FIG. 6, the upper end of the spring sleeve 73 has not yet engaged with the metal plate 39, and the lower end of the sheath 45 has not yet entered the narrowing throat 73*t* of the bore of the spring sleeve 73, and hence is not at this stage compressed radially against the outer surface of the conductor 5*c*. Hence at this stage, the conductors 5*c* can be removed or inserted into the bores in the assembly if desired.

The spring sleeve 73 is restrained within the second portion 32 by the inter-engaging shoulders 32*s*, 73*s*, and moves axially upwards within the bore 30*b* of the body 30 as the body portions 31 and 32 are screwed together, until the upper face of the upper section 74 of the spring sleeve 73 engages with the lower face of the metal plate 39 below the resilient sealing boot 40 as shown in FIG. 7. The front face of the spring sleeve 73 is then seated against the underside of the metal plate 38. At this stage, the spring 70 is still held in moderate compression between the circlip 72 and the spring sleeve 73, but the spring sleeve 73 is still held in its fully extended configuration with the shoulders 73*s* and 32*s* fully engaged. Hence, no further compression of the spring 70 has taken place at this stage. However, as is shown in FIG. 7, the lower end of the sheath 45 has passed through the narrowed throat 73*t* of the bore 73*c* in the spring sleeve 73 into the narrower diameter section of the bore 73*c*, and the axial relative movement between the sheath 45 and the spring sleeve 73 is radially compressing the sheath 45 between the inner surface of the bore 73*c* and the outer surface of the conductor 5*c*, and firmly clamping the sheath 45 against the outer surface of the conductor 5*c*. Repositioning of the conductor 5*c* within the bores at this stage is therefore restricted by the radial compression of the sheath 45.

Figure 10:
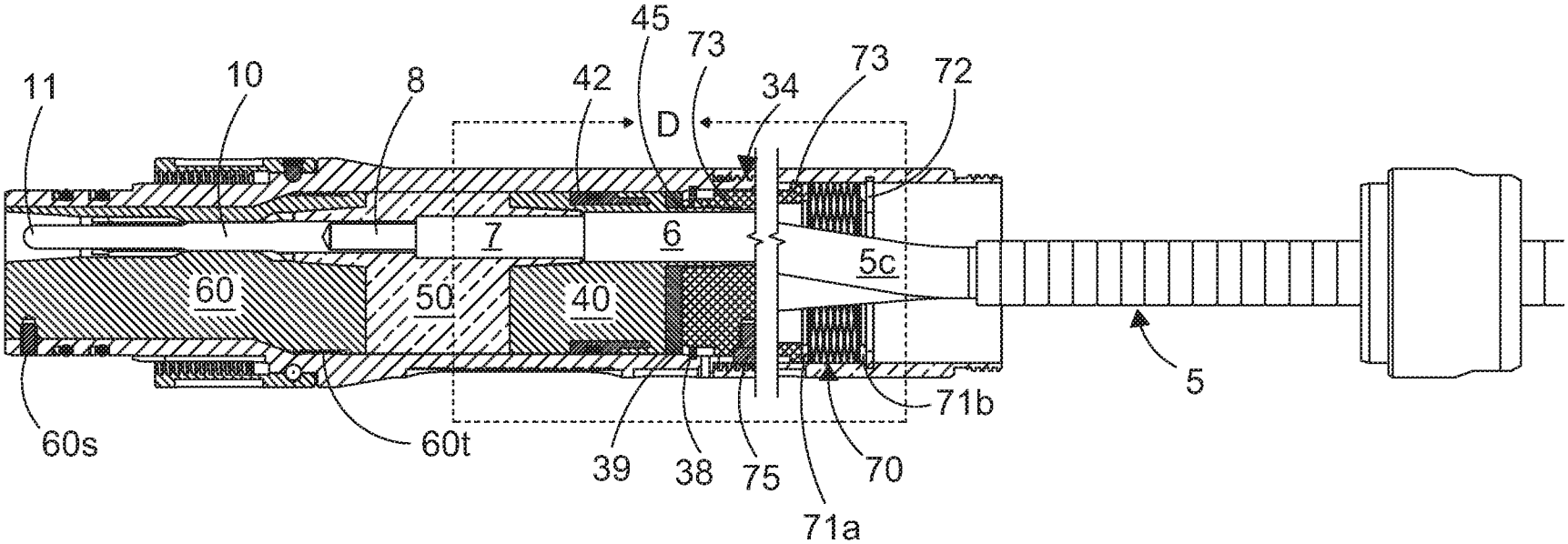
FIG. 10 shows the connector assembly of FIG. 6 with the rear portion of the assembly fully tightened, with the resilient compression device engaged and the sealing device energised.
Figure 11:
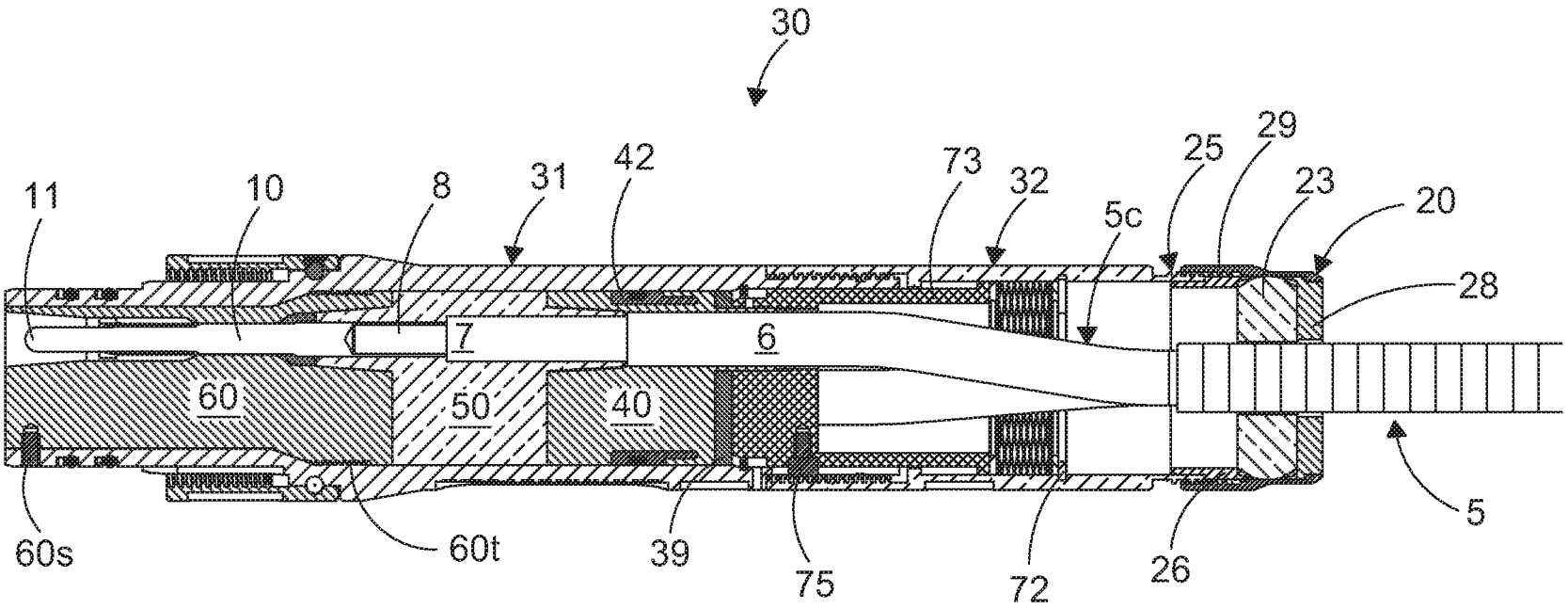
FIG. 11 shows the connector assembly of FIG. 10, with the end cap of FIG. 1 in position.
Figure 12:
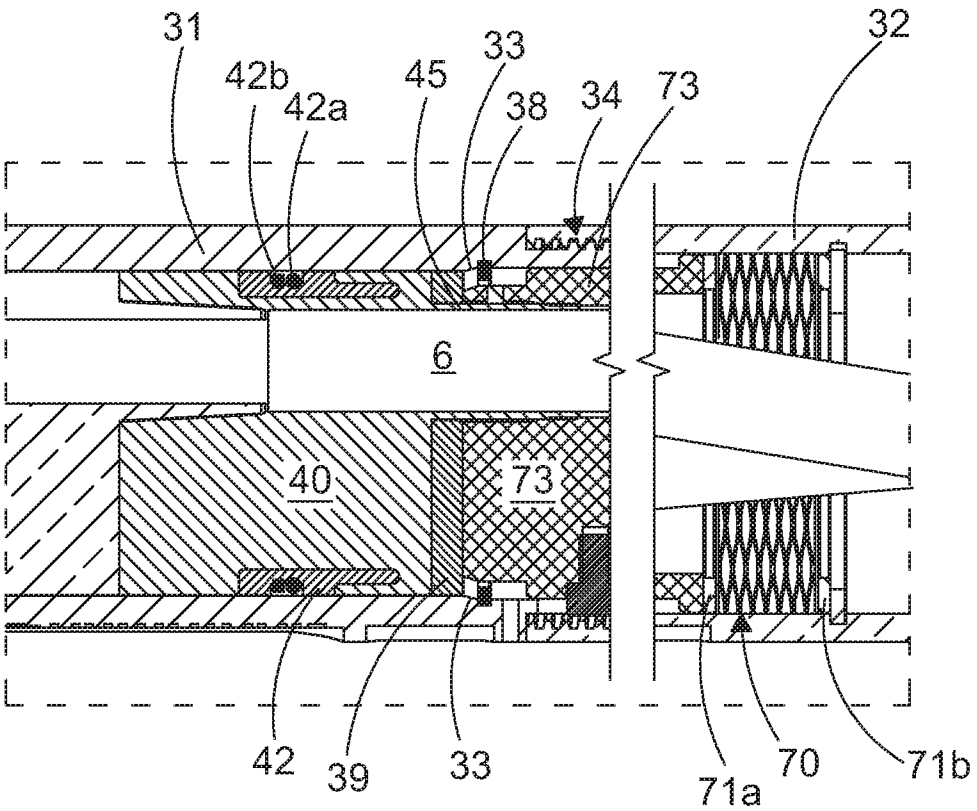
FIG. 12 is a close-up view of the section D of FIG. 10.

Further relative movement of the body portions 31, 32 as they are screwed together beyond the FIG. 7 point starts to move the spring sleeve 73 into the bore of the lower body portion 31, until the assembly reaches the configuration shown in FIGS. 10 and 11, in which the spring 70 has been about 60-80% compressed by the downward axial translation of the spring sleeve 73 in the lower body portion 32. At this stage, the energised spring 70 is urging the spring sleeve 73 upwards in the bore 30*b* against the underside of the metal plate 39, which is transmitting the axial force to all of the internal components of the assembly above it in the bore 30*b*, thereby compressing the resilient sealing boot 40, the insulation boot 50, and the insulation sleeve 60. The axial compression applied by the compressed spring 70 accommodates expansion and contraction of the internal components in the bore 30*b*, and maintains the seal, thereby reducing or restricting well bore fluids below the connector assembly 1 from tracking through the annulus between the body 30 and the conductors 5*c*. It is desirable that the spring 70 is not completely compressed at this stage, to allow for additional compression of the spring 70 in order to accommodate thermal expansion of the components in the bore.

Well bore pressure outside the body can be communicated through the fluid pathway comprising the port 30*p* between the outer surface of the body 30 and the bore 30*b*, exposing the bore below the sealing boot 40 to the well bore pressure outside the body 30. The pressure differential between the external surface of the body 30 and the inside of the bore 30*b* thus applies additional force to the internal components, increasing the sealing force applied to the sealing boot 40.

The axial force urging the spring sleeve 73 compresses the sheath 45 of the sealing boot 40 within the bore 73*c* between the inner surface of the bore 73*c* and the outer surface of the conductor 5*c* in the bore 73*c*, and hence improves the resistance of the spring sleeve 73 to passage of fluids through the bore 30*b* or along the conductor 5*c*.

Once the two body parts 31, 32 have been connected and fully screwed together, the gland 20 can be made up with the lower end of the lower body portion 32 to at least partially seal off the bore 30*b* at the lower end of the assembly 1. The lock ring 29 on the gland 20 is threaded onto the (lower) second portion 32 of the body along the threaded connection 25. The low friction PEEK ring 26 is pressed against the end of the body portion 32 when the lock ring 29 is in position, and the ring 26 reduces friction between the rubber bung 23 and the body during relative rotation to make up the gland 20. At the outer end of the gland 20 is a metal ring 28, which presses against the rubber bung 23 when the assembly is threaded in place. This compresses the rubber bung 23 and presses the rubber bung 23 into the conductor 5 for at least partial sealing against fluid ingress.

Figure 13:
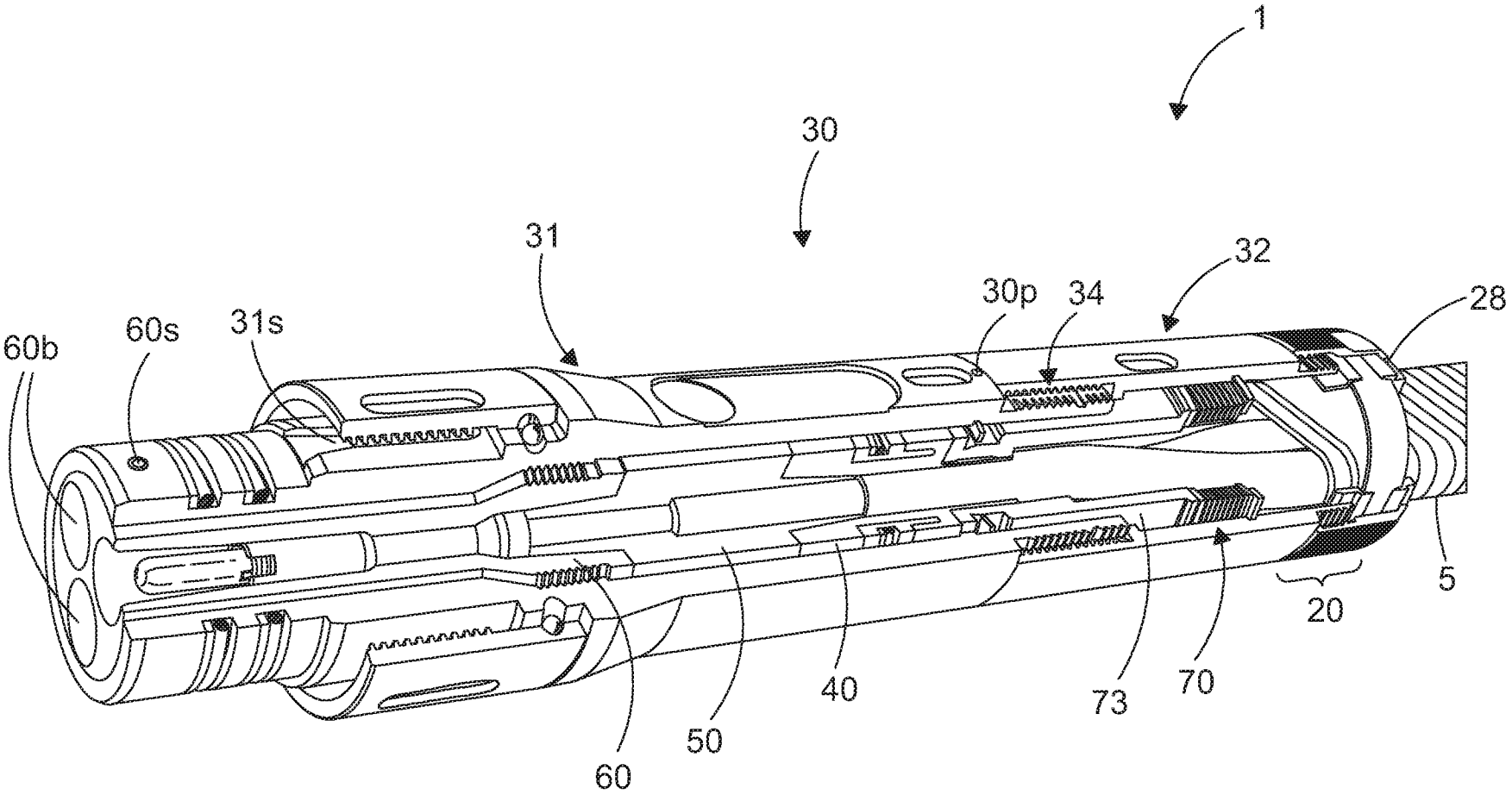
FIG. 13 is a three dimensional view of the assembly as shown in FIG. 11.

FIG. 13 shows a three-dimensional partial cut-away view of the installed assembly 1. The spring 70 is maintaining compression on the internal components in the bore of the body 30, and the arrangement also increases radial compression of various internal components, e.g. the sealing boot 40, radially inwards against the outer surface of the conductors 5*c*, which increases the sealing effectiveness. The spring 70 is optionally still able to compress in the event of expansion of any of the internal components in the bore, and this prevents thermal expansion events from damaging the conductor, as well as maintaining the optimum compression necessary to contain the well bore fluids in the bore of the connector.

Figure 14:
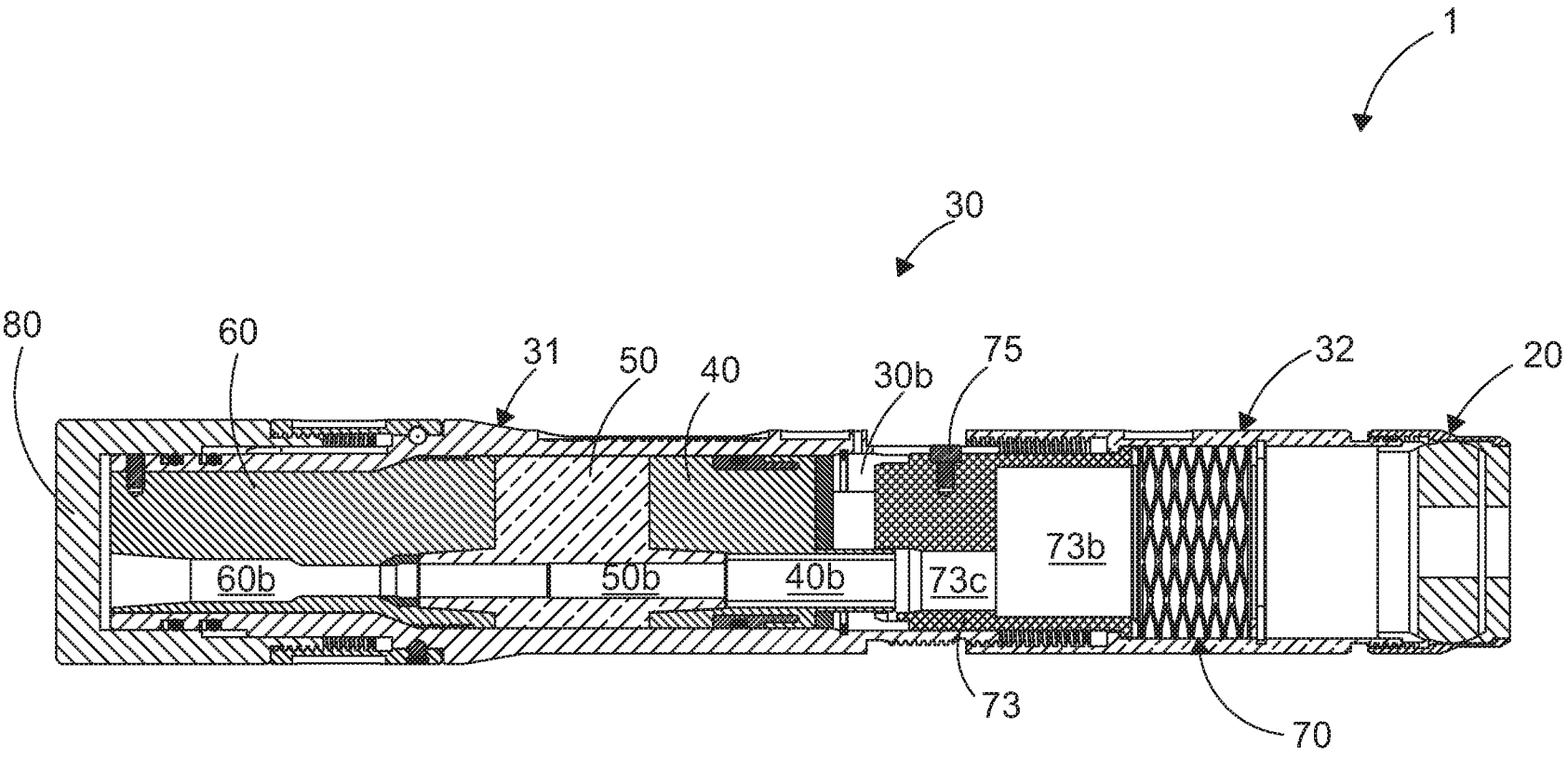
FIG. 14 is an alternative cross-sectional view of the connector assembly of FIG. 11.

FIG. 14 shows the assembly body 30 with an optional end cap 80 threaded into place and installed onto the end of the body 30, but before the conductors 5*c* have been inserted into the bore of the body 30. The body 30 is optionally delivered to the well site in this partially made up configuration, with the spring sleeve 73 not engaging the internal components as it is axially spaced from the metal ring 39, and the sheath 45 is only received in the wide mouth 73*m* of the bore 73 and has not been compressed by the narrow throat 73*t*. At this stage, therefore, the end cap 20 can be easily removed and the conductors 5*c* can be passed through the body as all bores 73*c*, 40*b*, 50*b*, and 60*b* are aligned, and the terminals 10 can be crimped in place on the ends of the conductors 5*c*, after which the body portions 30, 31 can be screwed together, which drives the spring sleeve 73 upwards in the bore as the spring 70 is compressed which axially urges the boots 40, 50 and the sleeve 60 and radially compresses the sheath 45 in the narrow throat 73*t* of the bores 73*c*. After assembly as indicated above, the assembly 30 is installed in a penetrator bore passing through a pressure barrier ready for connection to a mating connector assembly on the other side of the pressure barrier. When the assembly 30 is subjected to fluid pressure differentials from one side of the pressure barrier to the other, for example, most often the pressure of wellbore fluids at high pressure below the pressure barrier, which would be the case in a wellhead for example, the high pressure of the wellbore fluids below the pressure barrier is communicated to the sealing boot 40 via the fluid pathway comprising the ports 30*p* and 77. The pressure in the bore 30*b* below the sealing boot 40 is optionally equalised throughout the lower section of the bore 32*b*, and flows around the spring sleeve 73, spring 70 and other internal components within the bore, so there is a reduced risk of pressure differentials building up within the bore 32*b* below the sealing boot 40, hence, the pressure differential across the sealing boot 40 acts to compress the boot 40 axially upwards in the bore 30*b*, and compresses the sheath 45 radially inwards onto the conductor 5*c*. Higher pressure differentials across the sealing boot 40 therefore augment the seal.

The invention claimed is:

1. A penetrator assembly for connecting electrical conductors on opposite sides of a pressure barrier in an oil or gas well, the assembly comprising a body having a bore adapted to receive an electrical conductor within the bore, a sealing device adapted to seal an annular space between the electrical conductor and the bore, the sealing device being resilient, and a fluid pathway adapted to allow fluid communication between an external surface of the body and the annular space, wherein the fluid pathway comprises at least one port passing through the body into the bore, and wherein the port is adapted to transmit a pressure differential between the external surface of the body and the annular space to act on one side of the sealing device, wherein the resilient sealing device comprises an extended sheath portion configured to surround at least a portion of an outer surface of an electrical conductor, wherein the extended sheath portion of the sealing device extends from a body of the sealing device on said one side of the sealing device, wherein the extended sheath portion of the sealing device is in fluid communication with the annular space, whereby the pressure differential communicated to the annular area via the fluid pathway applies pressure to the extended sheath portion of the sealing device and forces the extended sheath portion of the sealing device radially against the outer surface of the electrical conductor, thereby creating or enhancing a seal between the extended sheath portion of the sealing device and the electrical conductor.

2. A penetrator assembly as claimed in claim 1, wherein the fluid pathway is adapted to transmit wellbore pressure on one side of the pressure barrier to a surface of the sealing device on the same side of the pressure barrier.

3. A penetrator assembly as claimed in claim 1, wherein the bore of the body is adapted to receive the sealing device, and wherein a resilient compression device is adapted to compress the sealing device against the outer surface of the conductor and against an inner surface of the bore.

4. A penetrator assembly as claimed in claim 3, wherein the resilient compression device surrounds at least a portion of the conductor.

5. A penetrator assembly as claimed in claim 3, wherein the resilient compression device comprises at least one bearing device arranged to reduce friction during rotational movement of one part of the assembly relative to another part of the assembly.

6. A penetrator assembly as claimed in claim 1, wherein the body is adapted to receive a plurality of electrical conductors within the body, wherein the sealing device comprises a respective extended sheath portion for each of the plurality of electrical conductors, wherein each extended portion of the sealing device extends from the lower end of the body of the sealing device.

7. A penetrator assembly as claimed in claim 3, wherein the bore tapers inwards towards the longitudinal central axis of the bore as the bore extends through the body, at least in a portion of the bore which receives the sealing device, and wherein axial movement of the sealing device under the force applied by the resilient compression device causes the sealing device to be compressed radially by the tapered bore and compressed axially as a result of the force applied by the compression device.

8. A penetrator assembly as claimed in claim 3, wherein the body comprises first and second portions connectable by a threaded arrangement, wherein said threaded arrangement is adjustable in order to vary the force energising the resilient compression device.

9. A penetrator assembly as claimed in claim 1, wherein the sealing device comprises a resilient boot having a bore to receive the conductor.

10. A penetrator assembly as claimed in claim 3, including a spring sleeve urged by a resilient compression device towards the sealing device, wherein the spring sleeve has a bore adapted to receive each conductor in the bore.

11. A penetrator assembly as claimed in claim 10, wherein the bore in the spring sleeve has a first portion and a second portion having a narrower diameter than the first portion, and wherein the spring sleeve is configured to move axially over the extended sheath portion of the sealing device, and wherein the extended sheath portion of the sealing device is adapted to be compressed radially between the inner surface of the narrow portion of the bore of the spring sleeve and the outer surface of the conductor received in the bore of the spring sleeve.

12. A method of connecting first and second limbs of an electrical conductor on opposite sides of a pressure barrier in an oil or gas well, the method comprising passing the first limb of the conduit into a body of a penetrator assembly, said body having a bore adapted to receive the first limb of the electrical conductor within the bore, wherein the method includes the steps of sealing an annular space between the first limb of the electrical conductor and the bore with a sealing device, the sealing device being resilient; communicating fluid between an external surface of the body and the annular space through a fluid pathway, wherein the fluid pathway comprises at least one port passing through the body into the bore; and transmitting a pressure differential through the port between the external surface of the body and the annular space to act on one side of the sealing device, wherein the resilient sealing device comprises an extended sheath portion configured to surround at least a portion of an outer surface of an electrical conductor, wherein the extended sheath portion of the sealing device extends from a body of the sealing device on said one side of the sealing device, wherein the extended sheath portion of the sealing device is in fluid communication with the annular space, and wherein the method includes creating or enhancing a seal between the extended sheath portion of the sealing device and the electrical conductor forcing the extended sheath portion of the sealing device radially against the outer surface of the electrical conductor using a pressure differential communicated to the annular area via the fluid pathway to apply pressure to the extended sheath portion of the sealing device.

13. A method as claimed in claim 12, including terminating the electrical conductor by crimping an electrical terminal onto the electrical conductor.

14. A method as claimed in claim 13, wherein the electrical terminal is crimped onto the electrical conductor at the oil or gas well.

15. A method as claimed in claim 12, the method including terminating the or each conductor at the oil or gas well by crimping an electrical terminal onto the or each electrical conductor to form at least one terminated conductor, inserting the or each terminated conductor into a pre-formed aperture within the assembly body, said aperture being adapted to mate with a connector assembly on the other side of the pressure barrier for transfer of electrical power or signals across the pressure barrier.

16. A method as claimed in claim 12, including resiliently energising a resilient compression device, and applying a compressive force from the resilient compression device to the sealing device within the annular space.

17. A method as claimed in claim 12, including accommodating expansion, contraction and movement of the components in the bore of the penetrator assembly by compression and expansion of the resilient compression device.

18. A penetrator assembly for connecting electrical conductors on opposite sides of a pressure barrier in an oil or gas well, the penetrator assembly having a body, the body having a bore with an axis, adapted to receive a plurality of electrical conductors within the bore, each electrical conductor having a terminal attached thereto, the penetrator assembly including a sealing device adapted to seal an annular space between the plurality of electrical conductors and the bore, and a fluid pathway adapted to allow fluid communication between an external surface of the body and the annular space, wherein the sealing device is resilient, wherein the fluid pathway comprises at least one port passing through the body into the bore, and wherein the port is adapted to transmit a pressure differential between the external surface of the body and the annular space to act on one side of the sealing device, wherein the sealing device comprises a respective extended sheath portion for each electrical conductor, each extended sheath portion being configured to surround at least a portion of an outer surface of an electrical conductor, wherein the extended sheath portions of the sealing device extend axially parallel to the axis from a body of the sealing device on said one side of the sealing device, wherein the extended sheath portions of the sealing device are in fluid communication with the annular space, whereby the pressure differential communicated to the annular area via the fluid pathway applies pressure to the extended sheath portions of the sealing device and forces the extended sheath portions of the sealing device radially against the outer surfaces of the electrical conductors, thereby creating or enhancing a seal between the extended sheath portions of the sealing device and the electrical conductors.

19. A penetrator assembly as claimed in claim 18, wherein each extended sheath portion of the sealing device has a bore to receive a respective electrical conductor, and wherein each extended sheath portion and conductor is received in a tapered bore in a sleeve abutting the sealing device, and wherein the sleeve is axially slidable relative to the sealing device, and wherein the bore of the sleeve is tapered, wherein the extended sheath portion of the sealing device is adapted to be compressed radially between the inner surface of the narrow portion of the bore of the sleeve and the outer surface of the conductor received in the bore of the sleeve.

20. A penetrator assembly as claimed in claim 18, wherein each conductor is terminated by a crimped end terminal, each crimped end terminal having a screw thread, and wherein the penetrator assembly comprises a conductor retaining nut for each crimped end terminal, each conductor retaining nut having a screw thread adapted to cooperate with the screw thread on the crimped end terminal on each conductor, to secure each conductor nut to its respective crimped end terminal.

* * * * *